US009631895B2

(12) United States Patent
Verba et al.

(10) Patent No.: US 9,631,895 B2
(45) Date of Patent: Apr. 25, 2017

(54) SHOCK PROTECTION FOR WEAPON MOUNTED DEVICES

(71) Applicant: MEPROLIGHT (1990) LTD., Or Akiva (IL)

(72) Inventors: Gregory Verba, Haifa (IL); Doron Segel, Netanya (IL)

(73) Assignee: MEPROLIGHT (1990) LTD, Or Akiva (IL)

( * ) Notice: Subject to any disclaimer, the term of this patent is extended or adjusted under 35 U.S.C. 154(b) by 0 days.

(21) Appl. No.: 14/766,135

(22) PCT Filed: Feb. 7, 2013

(86) PCT No.: PCT/IL2013/050115
§ 371 (c)(1),
(2) Date: Aug. 6, 2015

(87) PCT Pub. No.: WO2014/122639
PCT Pub. Date: Aug. 14, 2014

(65) Prior Publication Data

US 2016/0025449 A1 Jan. 28, 2016

(51) Int. Cl.
*F41C 27/00* (2006.01)
*F41G 11/00* (2006.01)

(52) U.S. Cl.
CPC ..... *F41C 27/00* (2013.01); *F41G 11/00* (2013.01); *F41G 11/002* (2013.01)

(58) Field of Classification Search
CPC ..... F41G 11/00; F41G 11/02; F41G 1/383; F41C 27/00
USPC ..... 42/122, 147, 90, 124, 125
See application file for complete search history.

(56) References Cited

U.S. PATENT DOCUMENTS 2,580,280 A * 12/1951 Bullard ..... F41G 1/38 33/298
2,625,742 A * 1/1953 Rawlings ..... G02B 27/32 33/298
5,434,704 A * 7/1995 Connors ..... G02B 23/12 250/333
5,745,287 A * 4/1998 Sauter ..... F41G 11/003 359/399
5,771,595 A * 6/1998 Bell ..... G02B 23/14 42/122
6,598,332 B1 * 7/2003 Jibiki ..... F41G 1/38 42/119
7,827,723 B1 * 11/2010 Zaderey ..... F41G 1/38 42/122
2006/0168871 A1 * 8/2006 Wagner ..... F41G 1/38 42/122
2009/0038203 A1 * 2/2009 McCarty ..... F41G 1/383 42/147

(Continued)

FOREIGN PATENT DOCUMENTS

DE 102010007834 8/2011

*Primary Examiner* — John D Cooper
(74) *Attorney, Agent, or Firm* — Soroker Agmon Nordman

(57) ABSTRACT

A device for mounting on a weapon or weapon station, including, an encasement for enclosing the device, a core element that provides a functionality of the device, a planar spring that is connected internally to a side of the encasement; and wherein the core element is coupled to one side of the planar spring, so that the core element is not in physical contact with the encasement.

22 Claims, 7 Drawing Sheets

(56) References Cited

U.S. PATENT DOCUMENTS

2009/0233751 A1* 9/2009 Schmidt ..... F16H 48/142
475/235

* cited by examiner

SHOCK PROTECTION FOR WEAPON MOUNTED DEVICES

TECHNICAL FIELD

The present disclosure relates generally to protecting sensitive elements of devices mounted on weapons or weapon stations from damage due to recoil of the weapon.

BACKGROUND

Many types of weapons such as machine guns, assault rifles, sniper rifles and other weapons are generally subject to a strong recoil force during use. The recoil is associated with a high level of impulsive acceleration (shocks). The recoil (also known as knockback, kickback, etc) is the backward sharp motion of the firearm following the moment that a bullet leaves the muzzle of the weapon. The recoil of the body of the weapon exactly balances the forward momentum of the bullet and exhaust gasses, according to law of conservation of momentum. The resulting weapon velocity equals the velocity of the bullet times the mass ratio, where the mass of the bullet also includes the mass of propellant gasses $V_{gun}=V_{bullet}(M_{bullet}/M_{gun})$. In most small weapons, the momentum is transferred to the ground through the body of the shooter. The body of the weapon experiences a sharp rise in its velocity over a very short time interval. Accordingly the weapon experiences a high acceleration experienced by the body of the weapon. Every component mounted on the weapon (e.g. through an accessory rail) experiences the force equaling its mass times the acceleration. Generally the weapon is made from strong materials which are not damaged by the recoil forces. However in recent years advanced devices have been designed to be added on to weapons to enhance a user's control, for example a thermal weapon sight (TWS) that allows night vision and vision through dust or smoke. The advanced devices are generally mounted on the accessory rail of the weapon and they include optical, electro-optical and electronic components that are sensitive to high level shocks.

A typical thermal weapon sight accepts an image using an infra-red imaging detector for example as manufactured by ULIS from Veurey-Voroize France. The imaging detector is coupled to an infra-red (IR) core that accepts the thermal image from the imaging detector processes the image and provides it for the user to view on a display (e.g. an OLED/LCD display in the TWS). A typical IR-core is manufactured by Opgal from Karmiel Israel.

The imaging detector and IR-core must be protected when assembled in the thermal weapon sight to prevent damage due to the high levels of shocks. The main failures that occur are component breakage and short term fatigue. Following is a list of problems that have been found to occur to the imaging detector and IR-core due to strong shocks:

1. Dead pixels on the weapon sight display. This is the most common failure.
2. Major damage to optical detectors (vacuum damage, microelectronic connection breakage and bonding wear out).
3. Breakage or wear out of electrical components.
4. Breakage or wear out of connections.

With some IR detectors models the pixel loss is so severe that the thermal weapon sight can become non-functional after being used in a single shooting session. To prevent such a problem some manufactures of IR detectors manufacture more expensive models that are encased in a stronger and more protective metal housing, and manufacture the detectors in a cleaner environments using more costly manufacture processes, instead of the low cost packaging and cost reduced manufacture processes. However this solution does not completely eliminate pixel loss and prevent the problems listed above. Additionally, the IR core would need to be heavily protected.

SUMMARY

An aspect of an embodiment of the disclosure relates to a device that is mounted on a weapon or weapon station, the device having a core element that provides a function of the device and that is protected from damage due to recoil shocks of the weapon. The protection is provided by coupling the core element to one side of a resilient planar spring inside the encasement of the device. The planar spring is connected between the sides of the internal walls of the encasement, so that the core element is suspended inside the encasement from the planar spring and not in physical contact with the walls of the encasement. Accordingly, shocks and vibrations are transferred to the core element only after being dampened by the planar spring.

In an exemplary embodiment of the disclosure, the core element is connected by a flexible wire to an electrical power source to power the core element. Likewise the core element is connected with a flexible data cable to a display, so that images provided by the core element can be viewed by a user of the weapon sight device.

In an exemplary embodiment of the disclosure, the core element includes an image detector, for example an IR detector. Additionally, the core element may include an IR core that processes the image provided by the image detector and provides it to a display so that it can be viewed by the user. Additionally, the core element can be any sensitive component of the device that needs to be protected.

There is thus provided according to an exemplary embodiment of the disclosure, a device for mounting on a weapon or weapon station, including:

An encasement for enclosing the device;

A core element that provides a functionality of the device;

A planar spring that is connected internally to a side of the encasement; and

Wherein the core element is coupled to one side of the planar spring, so that the core element is not in physical contact with the encasement.

In an exemplary embodiment of the disclosure, the planar spring is connected internally to at least two sides of the encasement. Optionally, the planar spring comprises multiple layers stacked together. In an exemplary embodiment of the disclosure, some of the layers have different thicknesses. Optionally, some of the layers are made from different materials. In an exemplary embodiment of the disclosure an elastic band surrounds multiple layers of the planar spring. Optionally, an elastic material is placed between the layers of the planar spring.

In an exemplary embodiment of the disclosure, the planar spring comprises:

a center part;

two arms extending from the center part, wherein one arm extends from a top of the center part and is attached internally to one side of the encasement, and one arm extends from a bottom of the center part and is attached internally to an opposite side of the encasement. Optionally, the center part has a cut out portion and forms a closed contour surrounding the cut out portion. In an exemplary embodiment of the disclosure, the arms surround the shape formed by center part and are attached to a side of the encasement opposite the side from which they originate from the center part.

In an exemplary embodiment of the disclosure, the device includes a display that is connected by a flexible data cable to the core element. Optionally, the device includes an electrical power source that is connected by a flexible electrical cable to the core element. In an exemplary embodiment of the disclosure, the device includes an optical arrangement to focus light onto an image detector in the core element.

Optionally, the planar spring has a cut out portion to allow the light to pass through the planar spring to the image detector. In an exemplary embodiment of the disclosure, the functionality includes serving as an image detector or serving as an image engine for a weapon sight device.

There is further provided according to an exemplary embodiment of the disclosure, a method of damping vibrations or shocks in a core element of a device mounted on a weapon or on a weapon station, comprising:

Coupling a planar spring internally to a side of an encasement of the device;

Coupling the core element to one side of the planar spring, so that the core element is not in physical contact with the encasement; and Wherein said core element provides a functionality of the device.

Optionally, the device includes an optical arrangement to focus light onto an image detector in the core element. In an exemplary embodiment of the disclosure, the planar spring has a cut out portion to allow the light to pass through the planar spring to the image detector. Optionally, the planar spring includes multiple layers stacked together. In an exemplary embodiment of the disclosure, the planar spring includes:

A center part;

Two arms extending from the center part, wherein one arm extends from a top of the center part and is attached internally to one side of the encasement, and one arm extends from a bottom of the center part and is attached internally to an opposite side of the encasement.

Optionally, the center part has a cut out portion and forms a closed contour surrounding the cut out portion. In an exemplary embodiment of the disclosure, the arms surround the shape formed by center part and are attached to a side of the encasement opposite the side from which they originate from the center part.

BRIEF DESCRIPTION OF THE DRAWINGS

The present disclosure will be understood and better appreciated from the following detailed description taken in conjunction with the drawings. Identical structures, elements or parts, which appear in more than one figure, are generally labeled with the same or similar number in all the figures in which they appear, wherein.

and

Figure 8:
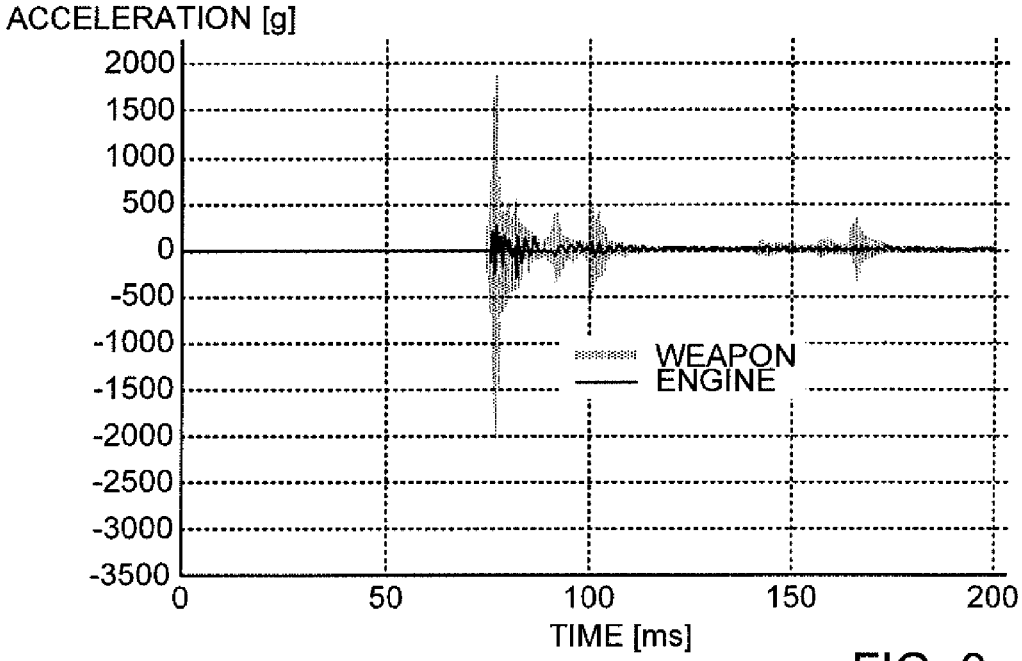

FIG. 8 is a graph illustrating an acceleration measurement of a thermal weapon sight encasement relative to an internal thermal weapon sight core along the vertical axis perpendicular to the recoil axis, according to an exemplary embodiment of the disclosure.

DETAILED DESCRIPTION

Figure 1:
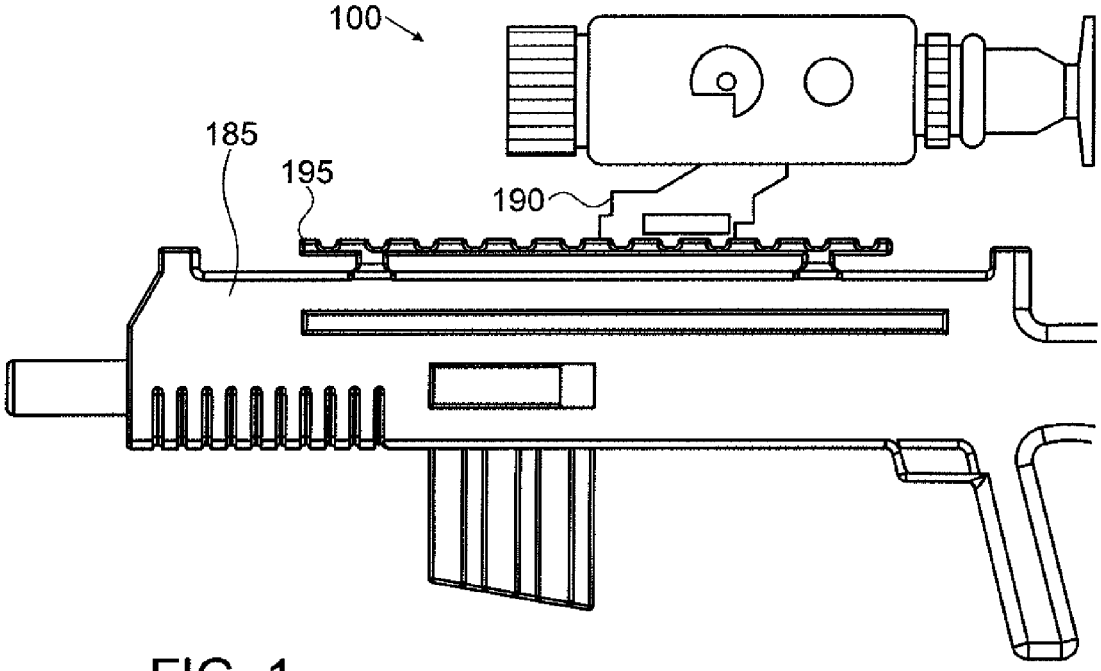
FIG. 1 is a schematic illustration of a weapon with a thermal weapon sight, according to an exemplary embodiment of the disclosure.

FIG. 1 is a schematic illustration of a weapon 185 with a thermal weapon sight 100, according to an exemplary embodiment of the disclosure. In an exemplary embodiment of the disclosure, weapon 185 includes an accessory rail 195 for mounting the thermal weapon sight 100 onto weapon 185 via an optional attachment mount 190. Accordingly, during use the recoil of weapon 185 incurs high accelerations transformed to thermal weapon sight 100 in all directions. In some embodiments of the disclosure the thermal weapon sight 100 may be an integral element of weapon 185. Optionally, weapon 185 may be any weapon that suffers from recoil, for example pistols, rifles, automatic/semi-automatic machine guns. The weapon may be hand held, transported on a vehicle or stationary. Optionally, thermal weapon sight 100 may be mounted on a weapon station which accommodates a weapon instead of directly on the weapon 185.

In an exemplary embodiment of the disclosure, thermal weapon sight 100 includes a core 105 (shown in FIG. 2) that provides the main electronic functionality of thermal weapon sight 100 or provides at least some functionality of the thermal weapon sight. In an exemplary embodiment of the disclosure the core 105 is mounted in thermal weapon sight 100 using a planar spring that dampens the accelerations exerted by the weapon recoil, so that the accelerations transferred to core 105 are reduced significantly. Although the disclosure specifically exemplifies use of a thermal weapon sight 100, it should be noted that the system and method provided herein are equally applicable to protect other devices/accessories mounted on weapons 185 or on a weapon station, wherein the devices/accessories include electronic circuits and/or sensitive elements that may be damaged by strong shocks or vibrations. In this description the term shock also includes vibration and vibration also includes shock.

Figure 2:
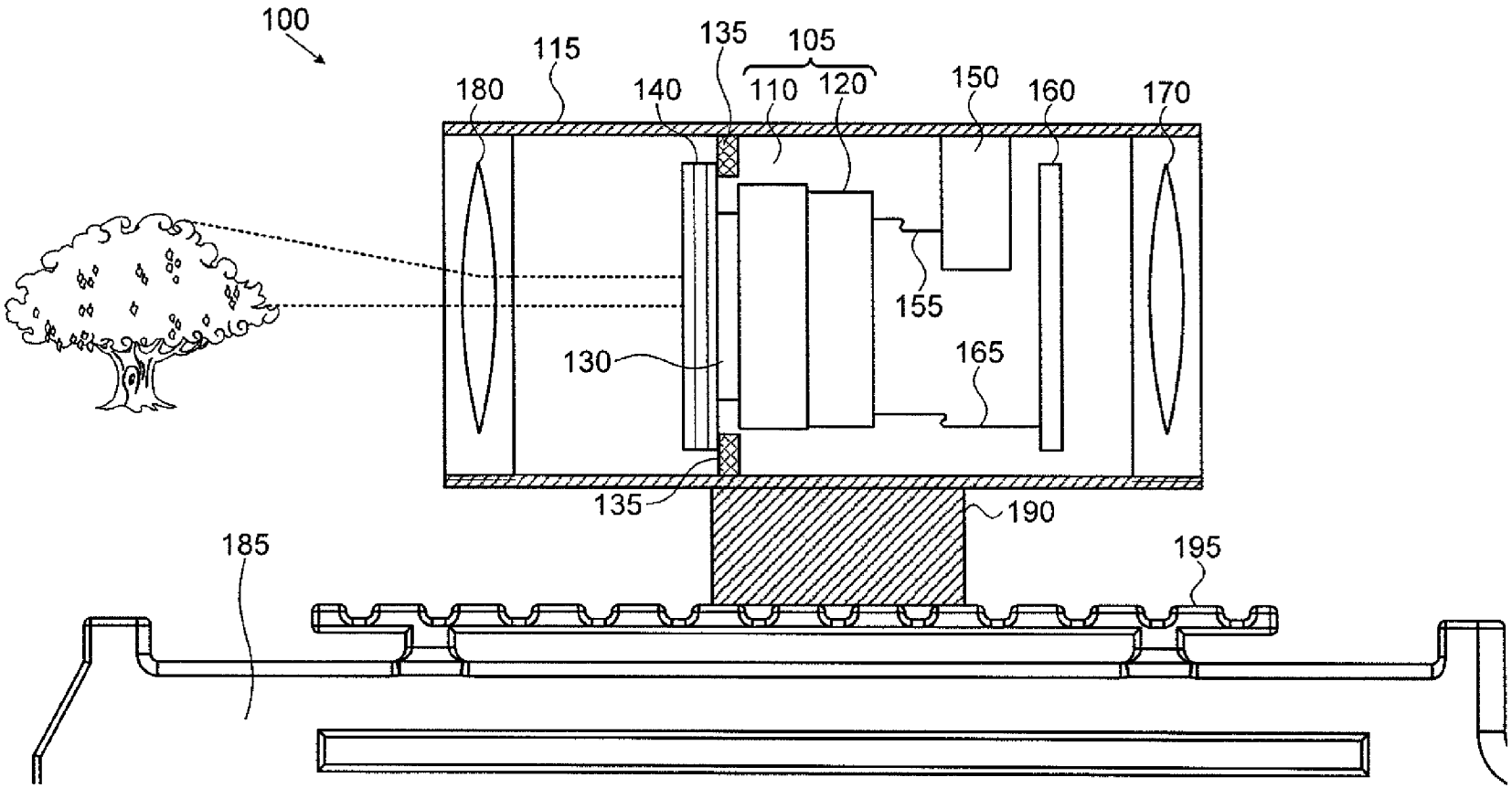
FIG. 2 is a schematic illustration of internal elements of a thermal weapon sight, according to an exemplary embodiment of the disclosure.

FIG. 2 is a schematic illustration of internal elements of a thermal weapon sight 100, according to an exemplary embodiment of the disclosure. In an exemplary embodiment of the disclosure, thermal weapon sight 100 includes an imaging detector 110 that records an image received through an arrangement of optical lenses 180 that focus infrared light on the imaging sensor 110. Optionally, the imaging detector is coupled to a imaging engine 120 that processes the image recorded by imaging detector 110 and provides it to a display 160, for example via a flexible data cable 165. Display 160 may be a plasma/LCD/LED/OLED display or other type of display. The user views the display through an arrangement of optical lenses 170, so that the user can focus the view of the display to fit his or her needs.

In an exemplary embodiment of the disclosure, the imaging engine 120 performs image processing using image processing algorithms such as dynamic range compression and contrast enhancement, helping the human eye detect what would normally be undetectable, regardless of operating temperatures. The imaging detector 110 and the imaging engine 120 together serve as the core 105 of thermal weapon sight 100. Optionally, thermal weapon sight 100 includes a power source 150 to provide power to the core 105, for example via a flexible power cable 155. The power source may use rechargeable or non-rechargeable batteries or be connected to external power sources to allow extending use of thermal weapon sight 100.

Figure 3:
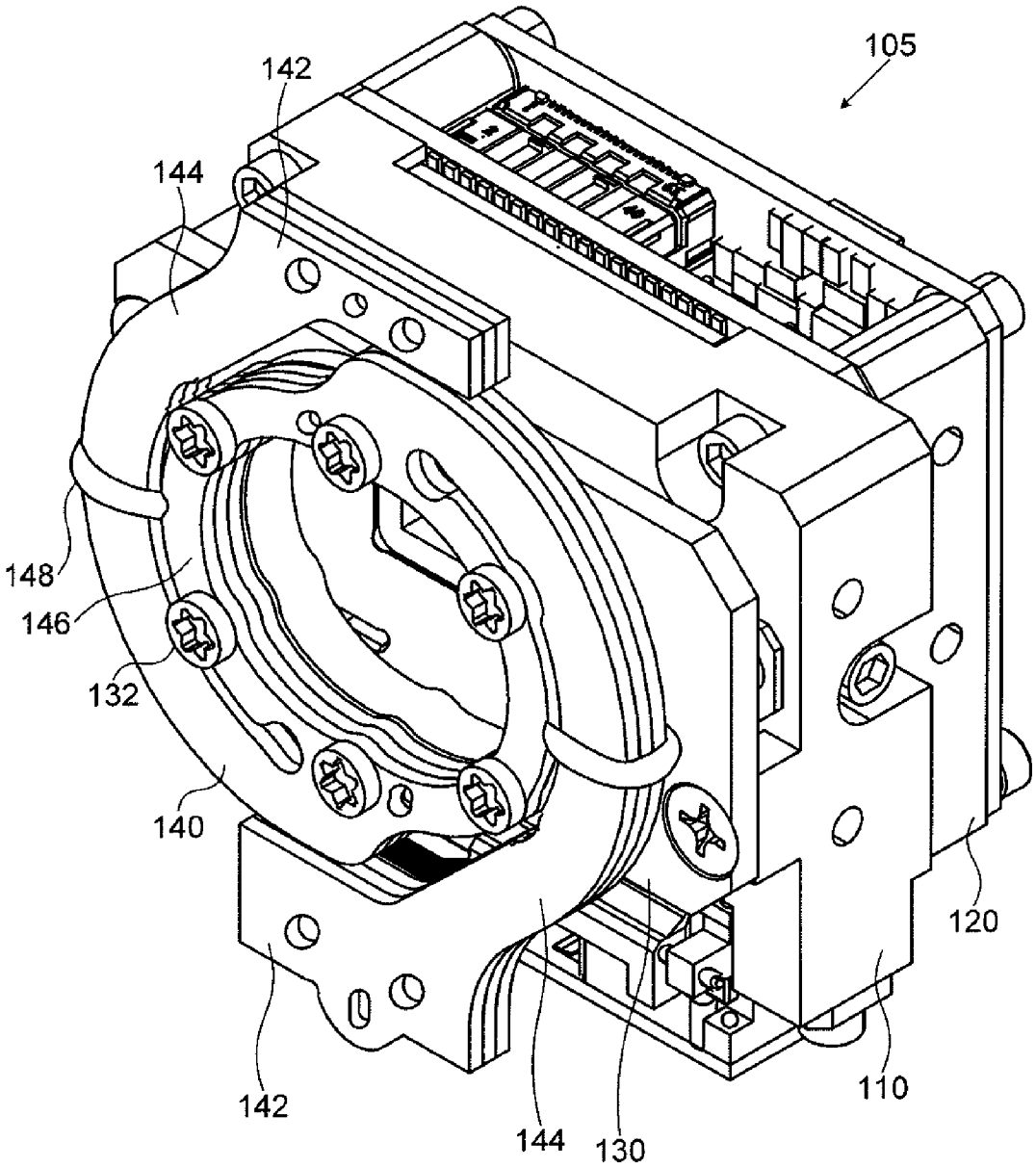
FIG. 3 is a schematic illustration of a perspective view of a spring protected thermal weapon sight core, according to an exemplary embodiment of the disclosure.
Figure 4:
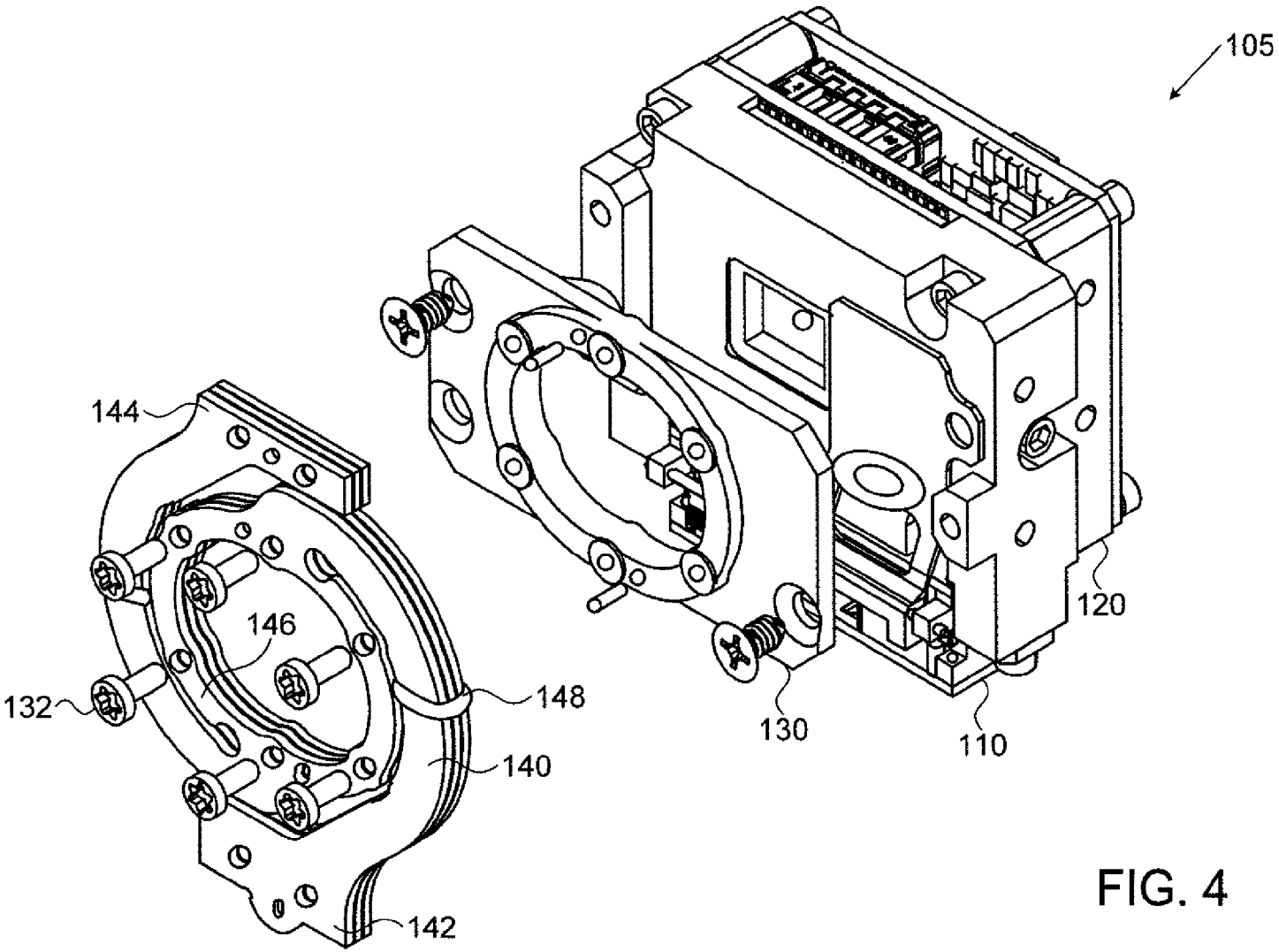
FIG. 4 is a schematic illustration of a perspective exploded view of a spring protected thermal weapon sight core, according to an exemplary embodiment of the disclosure.
Figure 5:
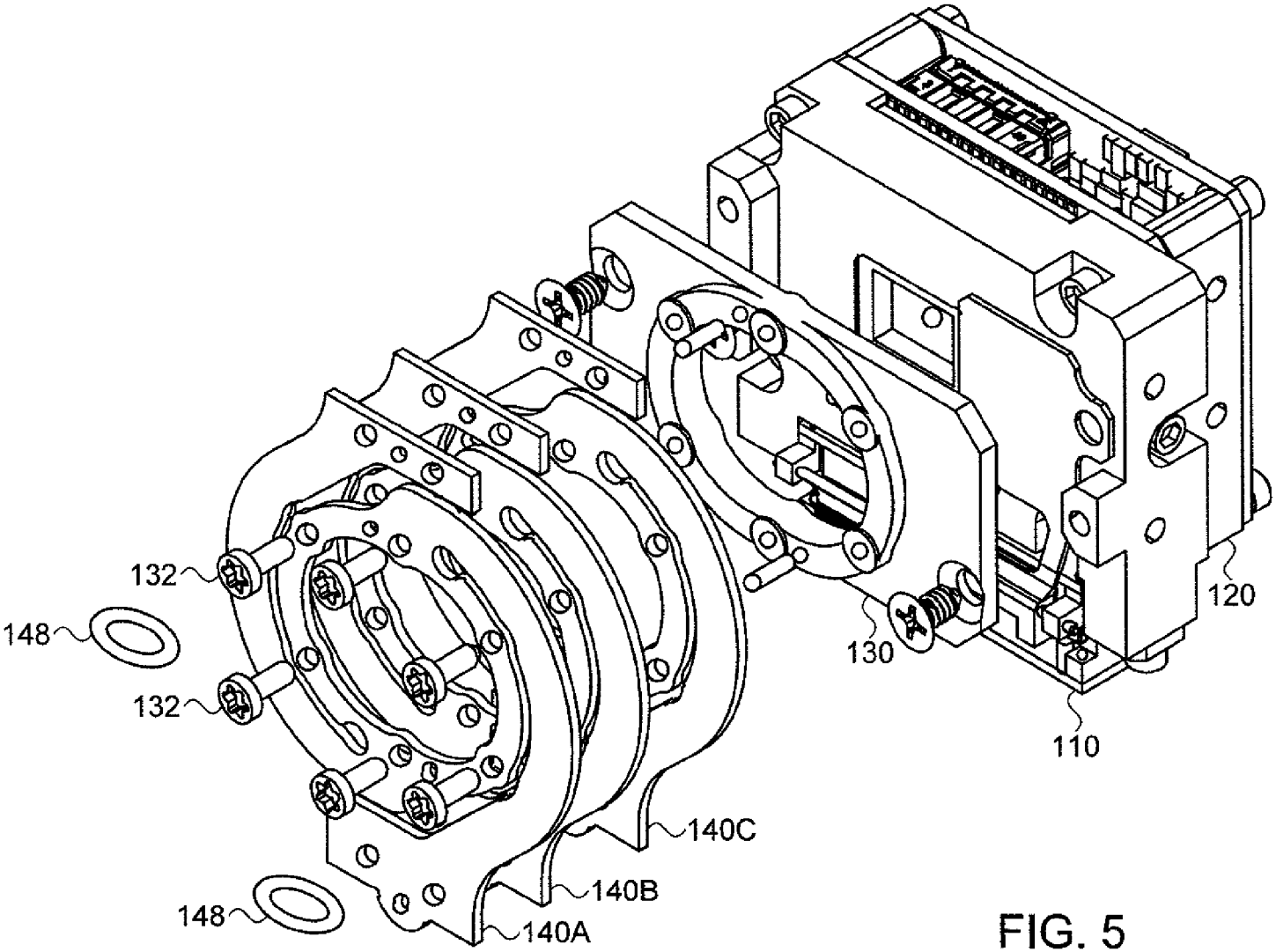
FIG. 5 is a schematic illustration of a perspective exploded view of a spring protected thermal weapon sight core, according to an exemplary embodiment of the disclosure.
Figure 6:
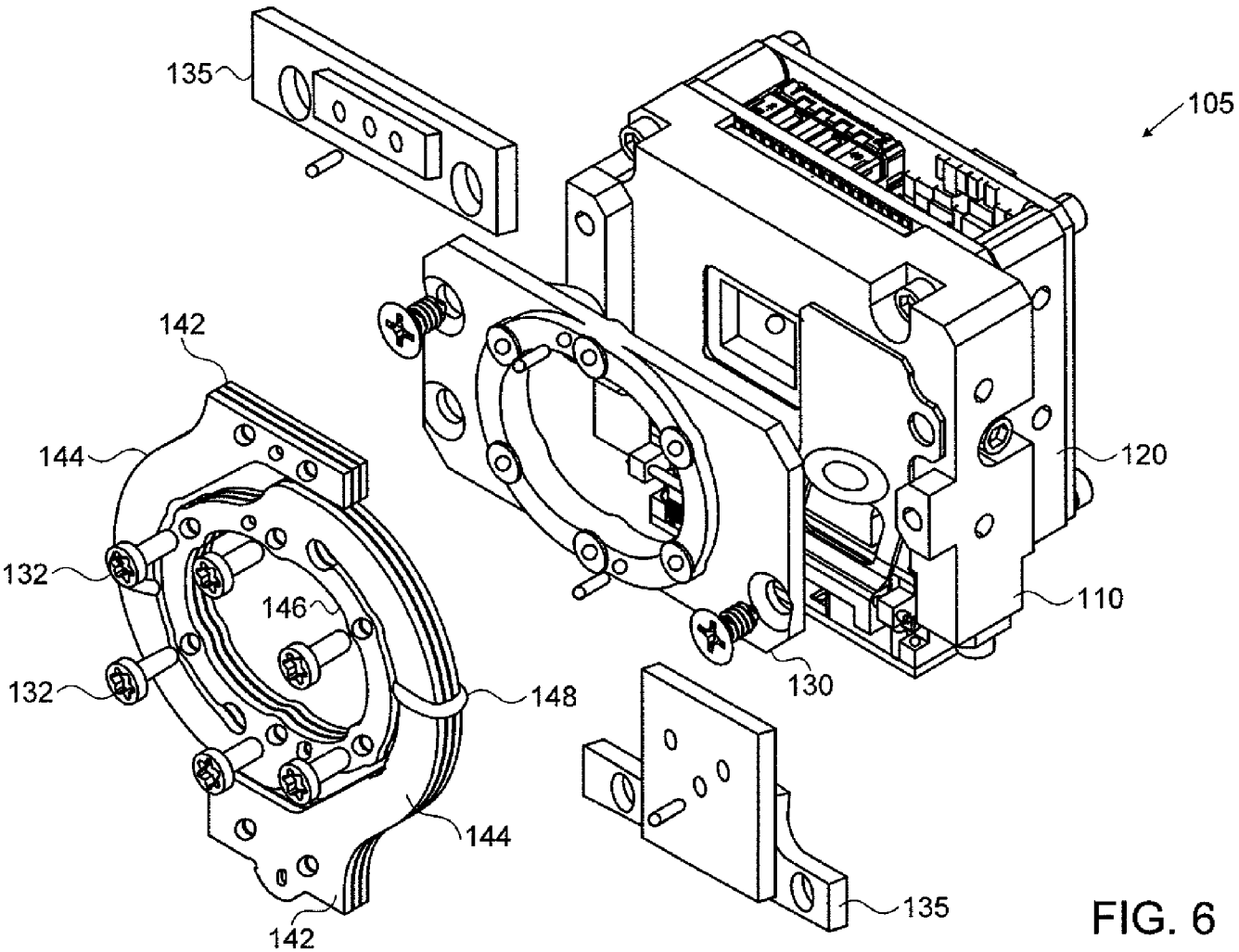
FIG. 6 is a schematic illustration of a perspective exploded view of a spring protected thermal weapon sight core, according to an exemplary embodiment of the disclosure.

In an exemplary embodiment of the disclosure, thermal weapon sight 100 is assembled in an encasement 115 having supports 135 on the internal walls of the encasement 115, for example extending from two or more of internal walls of the encasement 115 to hold core 105 inside the encasement without direct contact with the internal walls. Optionally, a planar spring 140 is attached to supports 135 on two opposite sides of the encasement 115 and core 105 is coupled to one side of the planar spring, so that core 105 will not be physically in direct contact with the internal walls of the encasement. Accordingly, shocks (e.g. recoil) from the weapon will be dampened by planar spring 140 and not transmitted directly to core 105. FIG. 3 is a schematic illustration of a perspective view of spring protected thermal weapon sight core 105, and FIGS. 4, 5 and 6 are perspective exploded views of the spring protected thermal weapon sight core 105, according to an exemplary embodiment of the disclosure. In an exemplary embodiment of the disclosure, planar spring 140 is made up from a thin planar sheet of resilient metal (e.g. stainless steel 302) that does not suffer from hysteresis so that it continually returns to its initial status. Optionally, the metal sheet may be cut by photo etching to form a thin sheet of the selected metal. In some embodiments of the disclosure multiple sheets may be stacked together to form a multi-layered planar spring, for example having 2, 3, 4 or more layers of planar springs (140A, 140B, and 140C in FIG. 5). The layers of planar spring 140 may have different thicknesses or be made from different materials. Alternatively, all the layers of planar spring 140 may be identical. Optionally, the various layers are stacked together so that they interact when responding to shocks and vibrations. In some embodiments of the disclosure various metals may be used, for example metal alloys based on Stainless Steel, Titanium, Beryllium Copper or other metals. Optionally, the damping intensity relies on the selected material and the dry friction between the adjacent layers of planar spring 140. In some embodiments of the disclosure, an elastic material is placed between layers of planar spring 140 to enhance damping.

In an exemplary embodiment of the disclosure, planar spring 140 is attached to a mounting interface 130 which is coupled to core 105. Optionally, screws 132 or nuts and bolts may be used to provide a secure attachment between planar spring 140, mounting interface 130 and core 105.

In an exemplary embodiment of the disclosure, planar spring 140 is designed to have a center part 146 with a cut out portion, so that the center part forms a closed contour surrounding the cut out portion, for example a ring shaped center part to allow image sensor 110 to receive light passing through the cut out portion of planar spring 140. Optionally, center part 146 may be rectangular, square, multilateral or any other shape. In some embodiments of the disclosure, planar spring 140 may be attached to the opposite side of core 105 so that the center of planar spring 140 does not need to be cut out so as not to interfere with image recording by image sensor 110.

In an exemplary embodiment of the disclosure, planar spring 140 includes two or more arms 144 extending from center part 146. Optionally, the arms 144 surround substantially half of the shape formed by center part 146, so that one arm 144 extending from the top of center part 146 will be attached to the bottom of encasement 115 and one arm 144 extending from the bottom center part 146 will be attached to the top of encasement 115. Optionally, an interface 142 is situated at the end of arms 144 for attaching planar spring 140 to supports 135 of encasement 115, so that the spring will be held by encasement 115 and core 105 will be attached to the center part 146 of planar spring 140.

In some embodiments of the disclosure, an elastic band 148, for example made from rubber or silicone is positioned to grip the arms 144 of the planar springs 140 to enhance damping between multiple layers of planar spring 140 (e.g. 140A, 140B, 140C).

In an experiment conducted using an Ace assault rifle with 7.62×51 mm caliber bullets and having a thermal weapon sight 100 as described above mounted onto it, 600 bullets were shot while measuring the recoil acceleration of the thermal weapon sight 100 relative to the acceleration of the core 105 of the thermal weapon sight 100. Additionally, after every 20 bullets the status of the pixels of the display were analyzed to determine if any pixels were lost due to the recoil force or if other damage occurred. The results showed that no pixels were lost when using planar spring 140 to damp the shocks and vibrations caused by the weapon recoil as explained above. Additional tests were performed on other weapons such as Tavor 5.56 mm assault rifle, SCAR-H assault rifle and others with similar results.

Figure 7:
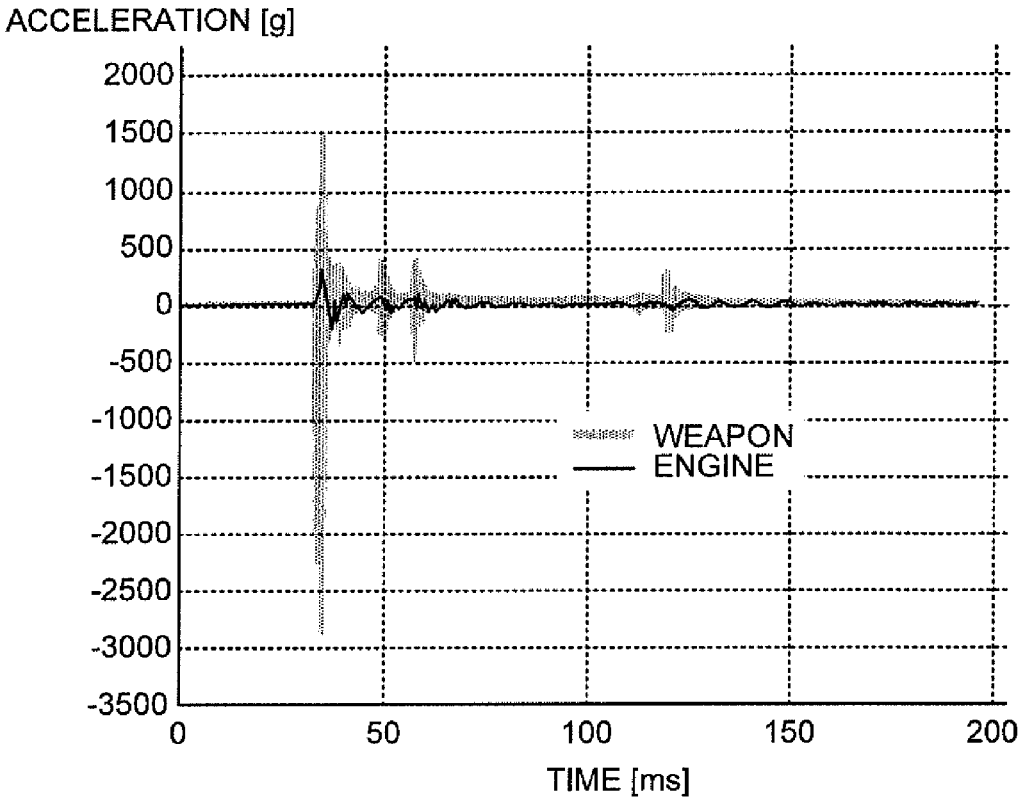
FIG. 7 is a graph illustrating an acceleration measurement of a thermal weapon sight encasement relative to an internal thermal weapon sight core along the recoil axis, according to an exemplary embodiment of the disclosure.

FIG. 7 is a graph illustrating the acceleration measurement of a thermal weapon sight encasement 115 relative to the acceleration of the thermal weapon sight core 105 along the recoil axis, and FIG. 8 is a graph illustrating the acceleration measurement of a thermal weapon sight encasement 115 relative to the acceleration of the thermal weapon sight core 105 along the vertical axis perpendicular to the recoil axis, according to an exemplary embodiment of the disclosure. In both graphs the grey line shows the acceleration of the thermal weapon sight encasement 115 due to the weapon recoil and the black line shows the damped acceleration at the core 105. Optionally, planar spring 140 caused the acceleration along the recoil axis to be reduced up to a ninth of the original measured acceleration (e.g. from 2850 g to about 300 g) and to be reduced up to a sixth along the vertical axis (e.g. from 2000 g to about 300 g). Optionally, the damping effect can be fine tuned by selecting the material of the planar spring 140, the number of planar springs 140 stacked together, thickness of the planar spring 140 and the rest of the geometry of the planar spring 140 (e.g. longer or shorter arms).

It should be appreciated that the above described methods and apparatus may be varied in many ways, including omitting or adding steps, changing the order of steps and the type of devices used. It should be appreciated that different features may be combined in different ways. In particular, not all the features shown above in a particular embodiment are necessary in every embodiment of the disclosure. Further combinations of the above features are also considered to be within the scope of some embodiments of the disclosure. It will also be appreciated by persons skilled in the art that the present disclosure is not limited to what has been particularly shown and described hereinabove.

We claim:

1. A device for mounting on a weapon or weapon station, comprising:

an encasement for enclosing the device;

a core element that provides a functionality of the device;

a planar spring that is rigidly connected internally directly or indirectly to a side of the encasement; and wherein the core element is directly coupled to a single side of the planar spring to be held by the planar spring in a void surrounded by the encasement without forming direct physical contact with the encasement or any rigid elements in the encasement.

2. A device according to claim 1, wherein the planar spring is rigidly connected internally directly or indirectly to at least two sides of the encasement.

3. A device according to claim 1, wherein said planar spring comprises multiple layers stacked together.

4. A device according to claim 3, wherein some of the layers have different thicknesses.

5. A device according to claim 3, wherein some of the layers are made from different materials.

6. A device according to claim 3, wherein an elastic band surrounds multiple layers of the planar spring.

7. A device according to claim 3, wherein an elastic material is placed between the layers of the planar spring.

8. A device according to claim 1, wherein the planar spring comprises:

a center part;

two arms extending from the center parts wherein one arm extends from one side of the center part and is rigidly attached internally directly or indirectly to one side of the encasement, and one arm extends from another side of the center part and is rigidly attached internally directly or indirectly to an opposite side of the encasement.

9. A device according to claim 8, wherein the center part has a cut out portion and forms a closed contour surrounding the cut out portion.

10. A device according to claim 8, wherein the arms surround the shape formed by center part and are attached to a side of the encasement opposite the side from which they originate from the center part.

11. A device according to claim 1, further comprising a display that is connected by a flexible data cable to the core element.

12. A device according to claim 1, further comprising an electrical power source that is connected by a flexible electrical cable to the core element.

13. A device according to claim 1, further comprising an optical arrangement to focus light onto an image detector in the core element.

14. A device according to claim 13, wherein the planar spring has a cut out portion to allow the light to pass through the planar spring to the image detector.

15. A device according to claim 1, wherein said functionality includes serving as an image detector or serving as an image engine for a weapon sight device.

16. A method of damping vibrations or shocks in a core element of a device mounted on as weapon or on a weapon station, comprising:

coupling rigidly a planar spring internally directly or indirectly to a side of an encasement of the device;

coupling the core element directly to a single side of the planar spring to be held by the planar spring in a void surrounded by the encasement without forming direct physical contact with the encasement or any rigid elements in the encasement;

wherein said core element provides a functionality of the device.

17. A method according to claim 16, wherein said device includes an optical arrangement to focus light onto an image detector in the core element.

18. A method according to claim 16, wherein the planar spring has a cut out portion to allow the light to pass through the planar spring to the image detector.

19. A method according to claim 16, wherein said planar spring comprises multiple layers stacked together.

20. A method according to claim 16, wherein the planar spring comprises:

a center part;

two arms extending from the center part, wherein one arm extends from one side of the center part and is rigidly attached internally directly or indirectly to one side of the encasement, and one arm extends from another side of the center part and is rigidly attached internally directly or indirectly to an opposite side of the encasement.

21. A method according to claim 20, wherein the center part has a cut out portion and forms a closed contour surrounding the cut out portion.

22. A method according to claim 20, wherein the arms surround the shape formed by center part and are attached to a side of the encasement opposite the side from which they originate from the center part.

* * * * *